United States Patent [19]

Sekiguchi

[11] 4,268,183

[45] May 19, 1981

[54] COMPOSITE WRITING INSTRUMENT

[75] Inventor: Kazuhiko Sekiguchi, Tokyo, Japan

[73] Assignee: Zebra Co., Ltd., Tokyo, Japan

[21] Appl. No.: 74,405

[22] Filed: Sep. 10, 1979

[51] Int. Cl.[3] ..... B43K 27/14

[52] U.S. Cl. ..... 401/30; 401/32

[58] Field of Search ..... 401/16, 17, 19, 20, 401/21, 27, 30, 32, 33, 99, 109, 110, 52, 67

[56] References Cited

U.S. PATENT DOCUMENTS

| | | | |
|---|---|---|---|
| 3,266,465 | 8/1966 | Ganz | 401/33 |
| 3,274,976 | 9/1966 | Levoin | 401/109 X |
| 3,814,524 | 6/1974 | Sperti | 401/110 X |
| 3,898,008 | 8/1975 | Ganz | 401/30 |
| 3,989,389 | 11/1976 | Hashimoto et al. | 401/30 |
| 4,080,077 | 3/1978 | Schumacher | 401/32 X |

FOREIGN PATENT DOCUMENTS

| | | | |
|---|---|---|---|
| 2746409 | 4/1978 | Fed. Rep. of Germany | 401/30 |

*Primary Examiner*—Edward M. Coven

*Attorney, Agent, or Firm*—Wenderoth, Lind & Ponack

[57] ABSTRACT

A composite writing instrument composed of two writing units such as two ball point and pen units which has a lower tubular casing accommodating therewithin two writing units and an upper tubular casing accommodating a cam mechanism therewithin which is rotatable about the axis of the casing for advancing the two writing units to a writing position through an opening at the tip of the lower tubular casing or for retracting the units to a holding position within the lower tubular casing. The cam mechanism is rotatable around the axis of the lower tubular casing as well as being engageable with both of the two writing units respectively for shifting the writing units in the axial direction, and the mechanism includes a guide casing having lengthwise grooves thereon and a curved casing accommodating the guide casing therewithin.

2 Claims, 12 Drawing Figures

COMPOSITE WRITING INSTRUMENT

BACKGROUND OF THE INVENTION

The present invention relates to a composite writing instrument having a common tubular casing accommodating two writing units such as two ball point pen units therewithin. In particular, the present invention relates to a composite ball point pen instrument in which two writing units are accommodated within a lower tubular casing and mutually spaced from each around the casing other by about 180°, and within an upper tubular casing is accommodated a cam mechanism rotatable around the axis of the casing through a certain angle and engageable with both of said two writing units for alternately shifting said writing units in the axial direction so as to advance said two writing units to a writing position through an opening in the tip of the lower tubular casing or to retract said writing units to a holding position located in said lower tubular casing by the rotational motion of said upper tubular casing around the axis.

There is already known a writing instrument provided with a lower tubular casing accommodating therewithin two ball point pen units with different color ink and an upper tubular casing accommodating therewithin a cam mechanism adapted to be engaged with said two ball point pen units. In such an instrument, the upper tubular casing is reciprocally rotatable around the axis of said lower tubular casing through a certain angle for alternately shifting said two ball point pen units to a writing position or a holding position. However, the cam mechanism of said writing instrument comprises, in general, a curved casing and a guide sleeve for holding one of the two ball point pen units in a writing position due to engagement of a slider fitted on said ball point pen unit with a notched portion formed on said curved casing.

SUMMARY OF THE INVENTION

The present invention has as its object to provide a composite writing instrument which is constructed in an extremely simple structure lacking the foregoing notched portion on said curved casing so as to be able to shift said writing units such as ball point pen units alternately to the writing position smoothly and reliably as well as to hold said writing units securely in the writing position.

BRIEF DESCRIPTION OF THE DRAWINGS

A typical embodiment of a composite writing instrument in the form of a ball point pen according to the present invention will now be described by way of example with reference to the attached drawings, in which;

FIG. 5(*b*) is a sectional view taken along the line B—B of FIG. 3; FIG. 5(*c*) is a sectional view taken along the line C—C of FIG. 2; and FIG. 5(*d*) is a sectional view taken along the line D—D of FIG. 1;

DESCRIPTION OF THE PREFERRED EMBODIMENT

Figure 1:
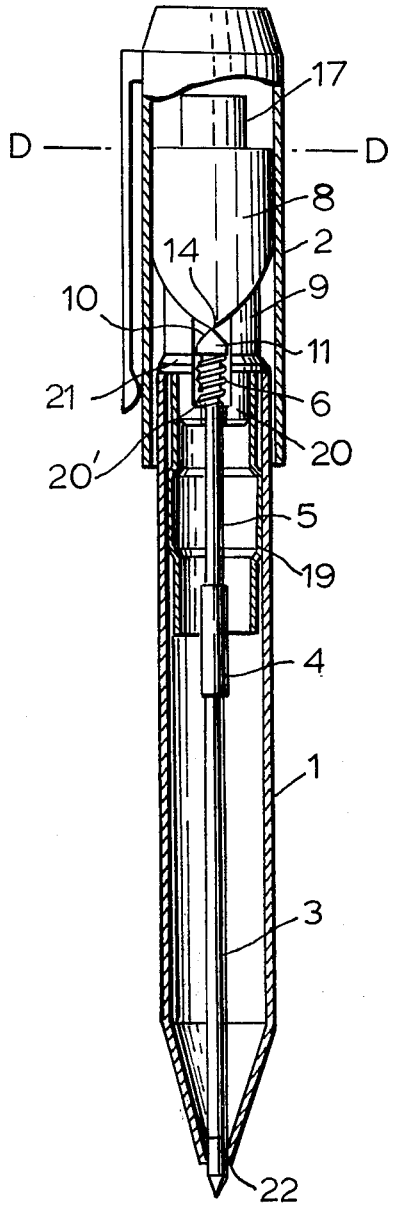
FIG. 1 is a longitudinal sectional view of a composite writing instrument composed of ball point pen units according to the present invention showing the internal structure accommodating one of said units therewithin in the writing position.
Figure 2:
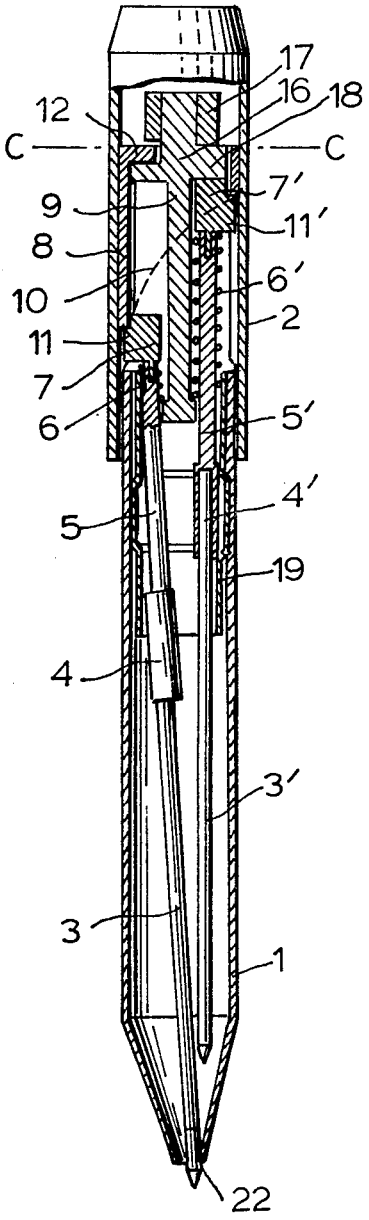
FIG. 2 is a longitudinal sectional view of the instrument of FIG. 1 taken in a plane rotated 90° around the axis of the instrument from the view in FIG. 1.
Figure 3:
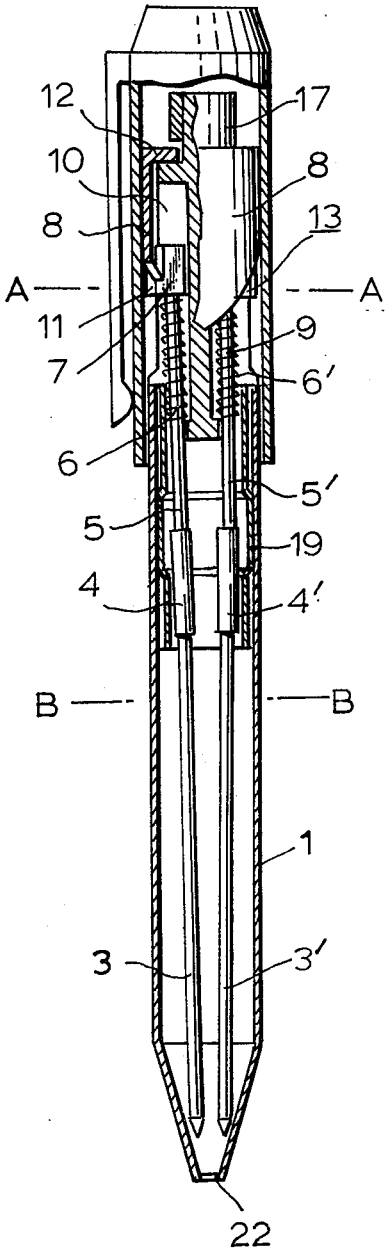
FIG. 3 is a partly broken sectional view of said instrument showing the state in which said units are located in the individual retracted positions.
Figure 4:
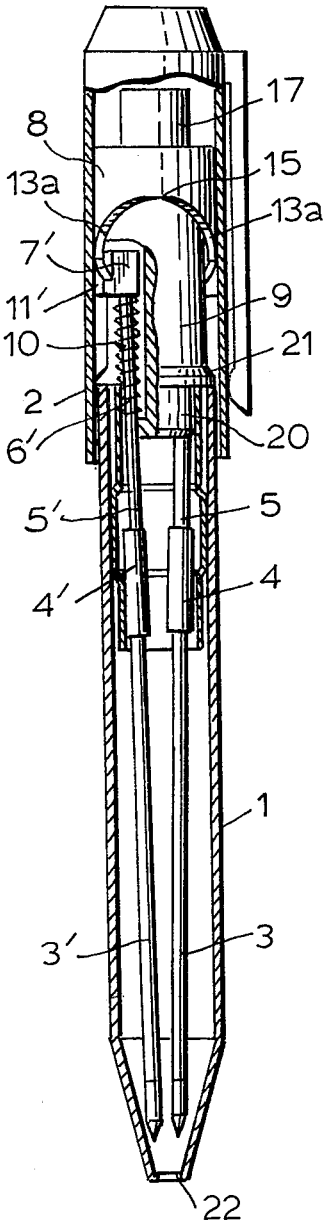
FIG. 4 is a partly broken sectional view of said instrument taken from the rear in FIG. 3.
Figure 5A:
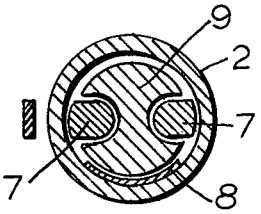
FIG. 5(*a*) is a sectional view taken along the line A—A of FIG. 3.
Figure 5B:
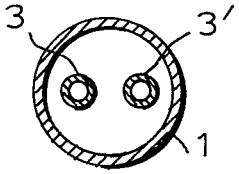
Figure 5C:
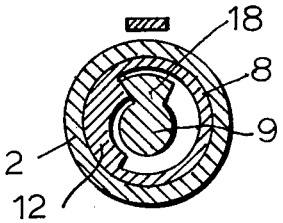
Figure 5D:
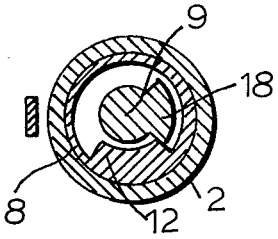

In the drawings, the reference numeral 1 designates a lower tubular casing, within which are accommodated the main bodies 3 and 3' of the ball point pen units. Said two main bodies 3 and 3' of the ball point pen units are coupled at the rear ends thereof respectively with rods 5 and 5' through connecting sleeves 4 and 4', and at the upper ends of rods 5 and 5' are provided sliders 7, 7'.

In the upper part of the lower tubular casing 1 there is tightly inserted a coupling sleeve 19 within which is tightly inserted the lower tubular part 20 of a guide sleeve 9. An annular projection 21 formed on said guide sleeve 9 is adapted in contact the lower tubular casing 1 at the upper end surface thereof to serve as a stop. Thus, the lower tubular casing 1 has said guide sleeve 9 firmly connected thereto.

The guide sleeve 9 has a cylindrical shape and is provided with guide grooves 10 and 10' which are mutually spaced from each other at 180° in the circumferential direction of the casing in order to guide said sliders 7 and 7' in the axial direction of said sleeve. The sliders are held in these guide grooves 10 and 10' by the coiled springs 6 and 6' respectively fitted on the rods 5 and 5' and are guided in a direction parallel to the axis of the casing along the guide grooves 10 and 10'. Said guide grooves 10 and 10' have a reduced width at the lower ends thereof to form stepped portions 20', said coiled springs 6 and 6' being supported at the lower in the axial direction of said sleeve. Within these guide grooves 10, 10' are elastically held said sliders 7, 7' provided on the tip of said rods 5, 5' by virtue of coiled springs 6, 6' respectively fitted to said rods 5, 5' as well as guided in the axial direction along said guide grooves 10, 10'. Said guide grooves 10, 10' are reduced in width at the lower parts thereof to form a stepped portion 20' respectively, thereby said coiled springs 6, 6' are supported at the lower ends thereof on said stepped portions 20'.

Said guide sleeve 9 has at the top portion thereof a stepped shaft head 16, and said shaft head 16 has on the peripheral side surface thereof a sector-shaped stop 18.

The guide sleeve 9 is slidably inserted in the axial direction into a curved casing 8 and is rotatable therein. On the curved casing 8 is formed a cam face 13 as is particularly apparent in FIG. 6. Said cam face 13, as is clearly illustrated in FIG. 6, has a flat portion 15 in the apex thereof which serves as a top face, and the top face 15 is joined at both ends thereof to inclined faces 13*a* on the right and the left ends of said top face 15 and symmetrically extending downward and coming together at a pointed tip 14. Pointed engaging portions 11 and 11' on the sliders 7 and 7' are adapted to have the slanted faces slidably engaged with the cam face 13 comprised of the inclined faces 13*a* and the flat portion 15 during the rotational motion of the curved casing 8.

Figure 6:
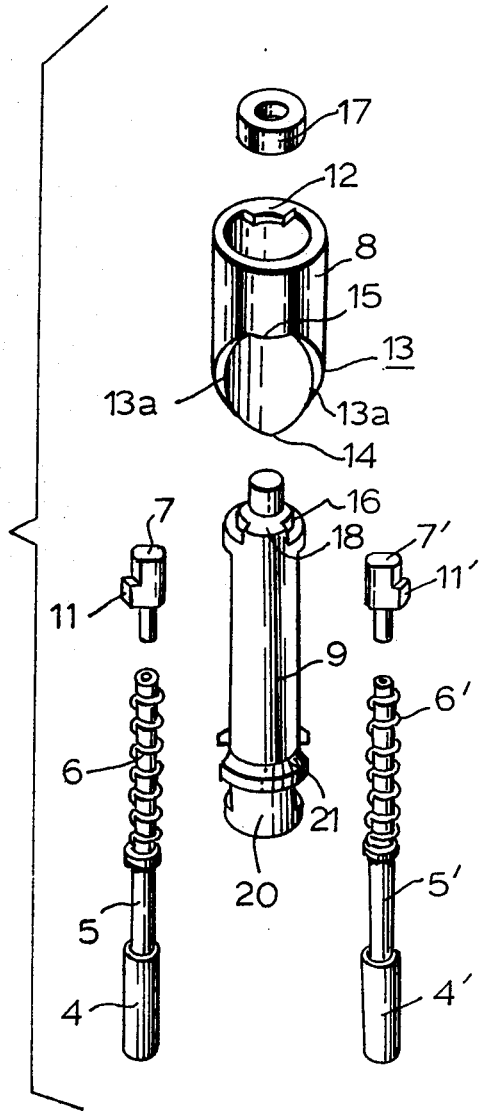
FIG. 6 is an exploded view of the cam mechanism showing each element thereof.

A sector-shaped stop 12 projects inwardly from the inner periphery of the upper end of the curved casing 8 as seen clearly in FIG. 6. This sector shaped stop 12 is engaged with the sector-shaped stop 18 on said shaft head 16, as will be described hereinafter, for restricting the rotational motion of the curved casing 8 with respect to the guide sleeve 9 to preferably in the range of about 180°+(5°~10°).

A fixing ring 17 is fitted on the shaft head 16 after the curved casing 8 has been put on the outside of the guide sleeve 9. Said fixing ring 17 cooperates with the sector-shaped stop 12 for checking the upward movement of said curved casing 8 by virtue of biasing force of the coiled springs 6 and 6'.

The upper tubular casing 2 is securely engaged with the outside of said curved casing 8 and the upper tubular casing 2 overlaps the lower tubular casing 1 at the lower end portion of said upper tubular casing 2, so that the two tubular casings may be slidable relative to each other. Since the curved casing 8 is, as will be explained later, rotatable in respect of the guide sleeve 9 through about 180°+(5°~10°) with the aid of said sector stoppers 12 and 18, the upper tubular casing 2 is also capable of effecting reciprocable rotational motion of about 180°+(5°~10°) relative to the lower tubular casing 1.

Next, the manner of displacement for advance of a pen unit to the writing position and retraction thereof to the retracted position according to the present invention will be described with reference to FIG. 7.

Figure 7C:
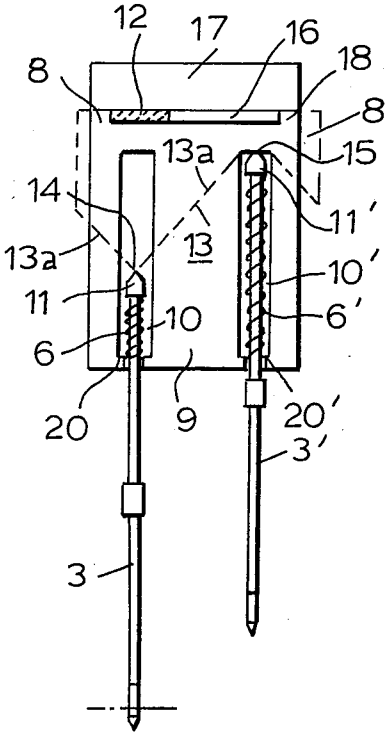
FIGS. 7(*a*) to (*c*) are diagrams showing the cam in developed form and the two ball point pen units and their movements to the writing position and the retracted position relative to the cam mechanism.
Figure 7B:
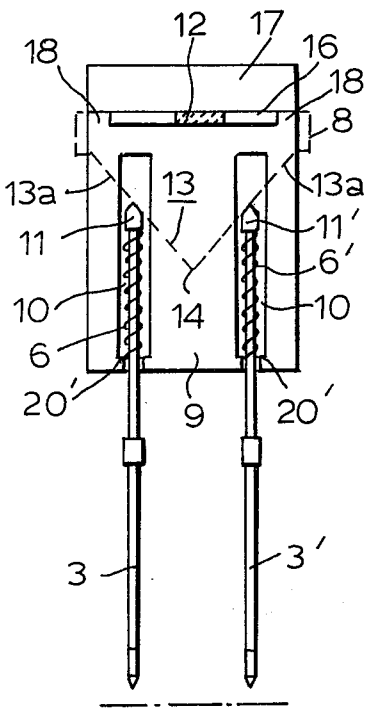
Figure 7A:
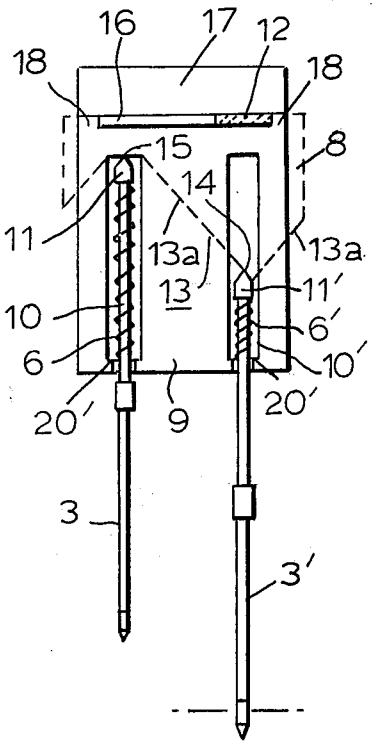

FIG. 7(*b*) shows the state of the main bodies 3 and 3' or both to said ball point pen units when they are in the retracted position. In this position, the inclined faces of the pointed engaging portions 11 and 11' which are mounted on the ends of the rods 5 and 5' and guided along the guide grooves 10 and 10' provided in the guide sleeve 9 are in resilient contact with the curved casing 8 near the middle of the inclined faces 13*a*, respectively, by virtue of the action of said coiled springs 6 and 6'. In this condition, however, the sector-shaped stop 12 located on the curved casing 8 at the top thereof is not in contact with the other sector-shaped stop 18 on the shaft head 16, but is located at a neutral position. The chain line below the main bodies 3 and 3' of said ball point pen units indicates the position of the opening 22 at the lower end of the tubular casing 1.

First, in order to advance the ball point pen unit with the main body 3' to the writing position, the upper tubular casing 2 and the curved casing 8 securely fitted thereto are rotated to the position shown in FIG. 7(*a*), in other words, a position where the sector-shaped stop 12 engages the other sector-shaped stop 18. During the rotational motion of the curved casing 8, the pointed engaging portion 11' provided on the rod 5' on the main body 3' of the ball point pen unit slides downward along one inclined face 13*a* of said curved casing 8 and stops right after said pointed engaging portion 11' has passed the pointed tip 14 at the lower end of said inclined face 13*a* on the other side of the tip 14. This is because of the fact that the angular motion during rotation of said curved casing 8 around the axis thereof is restricted to an angle within the range of 180°+(5°~10°) and the angular motion for the rotation of said curved casing 8 to the position shown in FIG. 7(*a*) from the position shown in FIG. 7(*b*) is an angular motion of slightly more than 90°, that is, the apex 14 comes into contact with the apex of the pointed engaging portion 11 when the angular motion of said curved casing 8 reaches 90°. The inclined face of the pointed engaging portion 11 provided on the rod 5 on the other main body 3 of said ball point pen unit is adapted to slide upwardly along the inclined face 13*a* of the curved casing 8 so as to be spaced from said inclined face 13*a* and is brought into contact with the flat portion 15.

In this manner the pen unit having the main body 3' is moved down into the writing position. Since the sector-shaped stop 12 is shaped to fit precisely in the clearance 16 formed between the fixing ring 17 engaging the lower face thereof and the guide sleeve 9 engaging the top face thereof, the ball point pen unit with main body 3' is adapted to be fixedly and reliably secured in the writing position and will not retract even when subjected to the pressure of the writing action. This pressure is transmitted to the inclined face 13*a* of the curved casing 8 from the inclined face of said pointed engaging portion 11' which is in contact with said inclined face 13*a* without causing any displacement in the axial direction on rotational motion around the axis of said curved casing 8 during the writing action.

Second, in order to shift the pen unit with the main body 3 for advancing it to the writing position, the curved casing 8 is rotated to the position as shown in FIG. 7(*c*) where the sector stopper 12 comes into contact with the other sector shaped stop 18 illustrated at the left hand side in the figure. In this instance, the pointed engaging portion 11 provided on the rod 5 on the main body 3 of the ball point pen unit is shifted downward along the inclined face 13*a*, and finally is held stationary right after having passed the pointed tip 14 of said curved casing 8. Thereby, the pen unit with the main body 3 is securely fixed in the writing position.

The present invention is thus able to provide a composite writing instrument having ball point pen units having an extremely simple structure and excellent durability which is effective for practical use, and wherein the two ball point pen units can smoothly and reliably be shifted to the writing position and the retracted position alternately even though there is no notched portion for engaging the slider member of each of ball point pen units in the sliding cam face on the curved casing of the cam mechanism.

What is claimed is:

1. A composite writing instrument comprising:

a tubular casing having an opening in the lower end thereof;

two writing units accommodated within said casing and spaced from each other by about 180° and movable between an advanced writing position in which the tip of the unit projects through said opening in the lower end of said tubular casing and a retracted position in which the unit is fully withdrawn into said lower tubular casing;

an upper tubular casing rotatably mounted on said lower tubular casing for rotation around the longitudinal axis of said lower tubular casing; and a cam mechanism within said upper tubular casing and rotatable around the axis of said lower tubular casing with said upper tubular casing through a limited angle of rotation and engaged with both of said writing units for alternately shifting said units in the axial direction between the advanced writing position and the retracted position, said cam mechanism comprising a curved casing within said upper tubular casing and rotatable with said upper tubular casing, a guide casing within said curved casing and fixed relative to said lower tubular casing and around which said curved casing is rotatable and having lengthwise grooves therein in which said two writing units are engaged for guiding said writing units in the axial direction of said instrument, and said curved casing having a cam face with an upper flat portion and two inclined portions extending symmetrically downward from both ends of said flat portion to a pointed tip, a slider on the upper end of each of said writing units and engaged with said cam face, and rotation limiting means operatively associated with said curved casing and said guide sleeve to slightly more than 90° in opposite rotational directions from a position in which both writing units are in an intermediate position within said lower tubular casing and said sliders are engaged with the respective inclined portions, the flat portion being about 90° along said cam face from said pointed tip, whereby when the curved casing is rotated in either direction from said position, one of said sliders is caused to slide downwardly along the associated inclined portion and just past the pointed tip to engage the other inclined portion, and the other slider is caused to slide upwardly along the associated inclined portion and to engage said upper flat portion, and the writing unit on which said one slider is mounted is moved to the writing position and held there and the writing unit on which the other slider is mounted is moved to the retracted position.

2. A composite writing instrument as claimed in claim 1 in which said rotation limiting means comprise a stop on said guide casing and a cooperating stop on said curved casing which engages said stop on said guide casing at the extremities of the rotational movement of said curved casing.

* * * * *